US012654978B2

(12) United States Patent
Bächler

(10) Patent No.: US 12,654,978 B2
(45) Date of Patent: Jun. 16, 2026

(54) ARRANGEMENT FOR TRANSPORTING A WIRE FROM A WIRE PROCESSING MACHINE TO A DISCHARGING POINT

(71) Applicant: RITTAL GMBH & CO. KG, Herborn (DE)

(72) Inventor: Andreas Michael Bächler, Haiger (DE)

(73) Assignee: RITTAL GMBH & CO. KG, Herborn (DE)

( * ) Notice: Subject to any disclaimer, the term of this patent is extended or adjusted under 35 U.S.C. 154(b) by 112 days.

(21) Appl. No.: 18/276,335

(22) PCT Filed: Dec. 21, 2021

(86) PCT No.: PCT/DE2021/101023

§ 371 (c)(1),
(2) Date: Aug. 8, 2023

(87) PCT Pub. No.: WO2022/174850

PCT Pub. Date: Aug. 25, 2022

(65) Prior Publication Data

US 2024/0124261 A1 Apr. 18, 2024

(30) Foreign Application Priority Data

Feb. 16, 2021 (DE) ..... 10 2021 103 561.9

(51) Int. Cl.
*B65H 51/16* (2006.01)
*B65H 51/18* (2006.01)
(Continued)

(52) U.S. Cl.
CPC ..... *B65H 51/16* (2013.01); *B65H 57/14* (2013.01); *B65H 59/105* (2013.01); *B65H 51/18* (2013.01);
(Continued)

(58) Field of Classification Search
CPC ..... B65H 51/00; B65H 51/16; B65H 51/18; B65H 51/28; B65H 51/30; B65H 57/12;
(Continued)

(56) References Cited

U.S. PATENT DOCUMENTS 3,754,694 A * 8/1973 Reba ..... B65H 51/16 226/97.4
3,917,141 A * 11/1975 Sartori ..... B65H 51/16 226/97.4
(Continued)

FOREIGN PATENT DOCUMENTS

CN 101514762 A 8/2009
CN 102996880 A 3/2013
(Continued)

OTHER PUBLICATIONS

International Search Report (English and German) and Written Opinion of the ISA (German) issued in PCT/DE2021/101023, mailed Mar. 25, 2022; ISA/EP.

*Primary Examiner* — Victoria P Augustine
*Assistant Examiner* — Raveen J Dias
(74) *Attorney, Agent, or Firm* — Harness, Dickey & Pierce, P.L.C.

(57) ABSTRACT

The invention relates to an arrangement for transporting a wire from an automatic wire processing machine to a discharging point, the arrangement comprising an automatic wire processing machine and an air pressure transport system, wherein a wire transfer interface between the automatic wire processing machine and the air pressure transport system comprises a wire receiving unit arranged in the access area of the automatic wire processing machine and a wire outlet which opens into at least one transport line of the air pressure transport system which is guided between the wire transfer interface and a discharging point.

17 Claims, 11 Drawing Sheets

Figure 1:
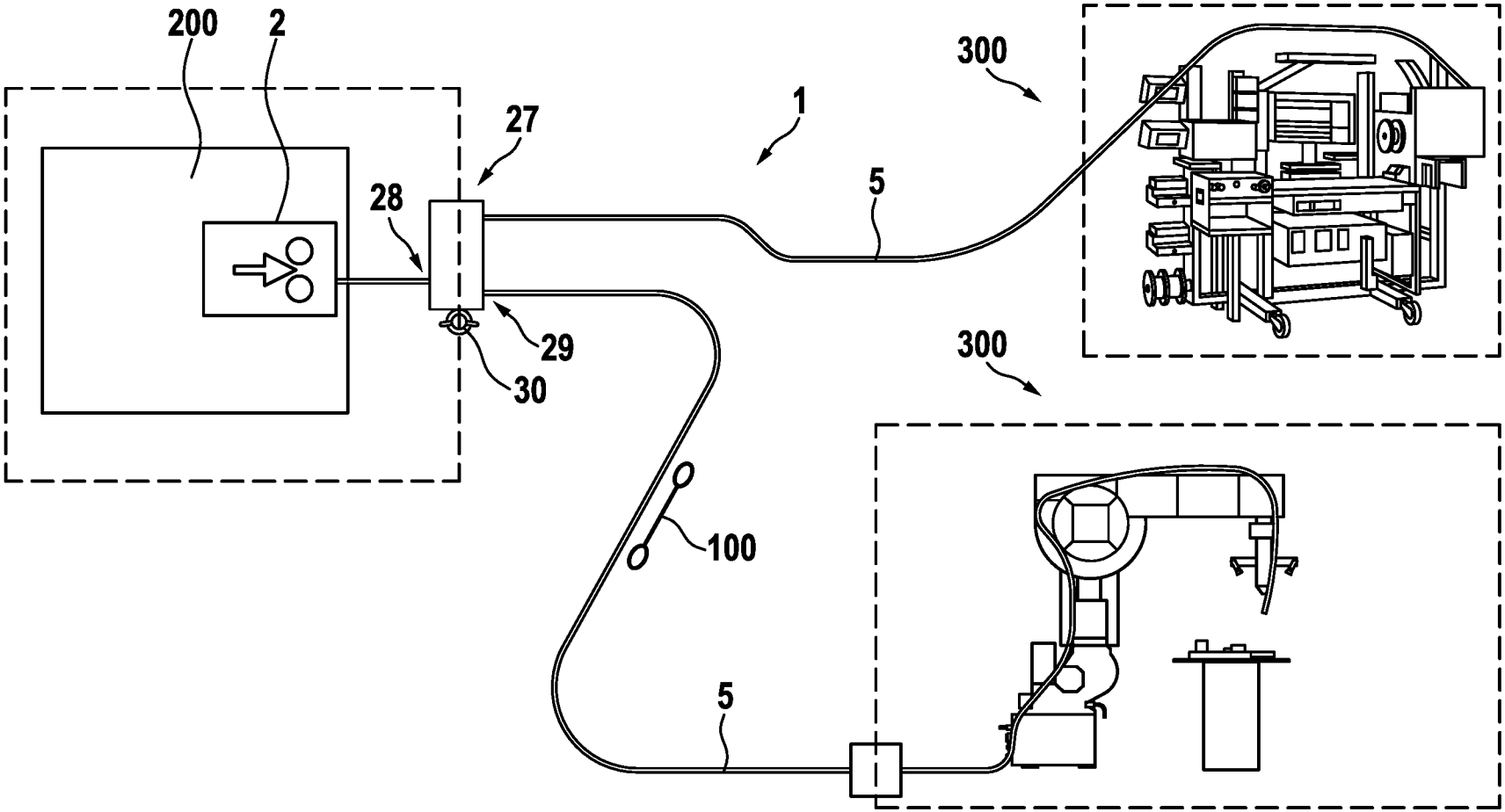

(51) Int. Cl.
*B65H 51/28* (2006.01)
*B65H 57/14* (2006.01)
*B65H 59/10* (2006.01)

(52) U.S. Cl.
CPC ..... *B65H 51/28* (2013.01); *B65H 2404/1364* (2013.01); *B65H 2701/341* (2013.01); *B65H 2701/36* (2013.01)

(58) Field of Classification Search
CPC .. B65H 57/14; B65H 59/105; B65H 2701/34; B65H 2701/341; B65H 2701/36; B65H 2404/1364
USPC ..... 242/615.11
See application file for complete search history.

(56) References Cited

U.S. PATENT DOCUMENTS 4,042,384 A * 8/1977 Jackson ..... B22F 5/006 242/615.11
4,285,285 A * 8/1981 Chambers ..... D05C 15/18 139/452
4,322,027 A * 3/1982 Reba ..... D04H 3/16 226/97.4
4,346,504 A * 8/1982 Birk ..... B65H 51/16 28/240
4,412,371 A * 11/1983 Hagen ..... B65H 51/16 28/255
4,607,430 A * 8/1986 Young ..... H01B 13/01245 29/33 F
4,705,583 A * 11/1987 Zuber ..... H01B 13/0016 242/615.11
5,065,928 A * 11/1991 Davey ..... G02B 6/4485 226/7
5,569,865 A * 10/1996 Profe ..... B65H 51/16 28/271
6,116,578 A * 9/2000 Pruett ..... H02G 11/02 254/134.4
6,390,349 B1 * 5/2002 Valenzuela ..... B23H 7/10 226/97.4
6,402,123 B1 * 6/2002 Rivard ..... G02B 6/52 254/134.4
8,442,664 B1 * 5/2013 Guglielmo ..... H01R 43/28 29/33 M
9,257,808 B1 * 2/2016 Guglielmo ..... H01B 13/01209
9,315,342 B1 4/2016 Mitchell et al.
12,218,492 B2 * 2/2025 Abrass ..... G06T 7/73
12,281,416 B2 * 4/2025 Peuker ..... D01H 5/32
2012/0171382 A1 * 7/2012 Mullin ..... B65H 57/12 414/217
2013/0067878 A1 * 3/2013 Stephan ..... D01H 1/115 57/78
2015/0336767 A1 11/2015 Ondo
2016/0002830 A1 * 1/2016 Stündl ..... D02G 1/161 28/267
2018/0174715 A1 6/2018 Porter
2019/0023522 A1 * 1/2019 Bahlmann ..... B65H 54/88
2020/0224337 A1 * 7/2020 Mohr ..... D01H 1/115
2022/0072713 A1 * 3/2022 Bächler ..... B25J 13/08
2022/0166197 A1 * 5/2022 Bach ..... B25J 15/0033
2023/0008282 A1 * 1/2023 Wagner ..... B65H 54/205
2024/0140755 A1 * 5/2024 Zhao ..... B65H 59/105

FOREIGN PATENT DOCUMENTS

CN 103180599 A 6/2013
CN 105247173 A 1/2016
DE 2106683 C3 12/1987
DE 3805584 A1 8/1989
DE 69107103 T2 5/1995
DE 69229099 T2 11/1999
DE 102018133319 A1 6/2020
DE 102019106710 A1 9/2020
EP 0182592 A2 5/1986
EP 0445622 A2 9/1991
EP 0544388 A1 6/1993
EP 0654436 A1 5/1995
GB 1342907 A 1/1974
JP S45-005313 8/1970
JP H05-011125 A 1/1993
JP 2012-180149 A 9/2012
WO 2019211490 A1 11/2019

* cited by examiner

ARRANGEMENT FOR TRANSPORTING A WIRE FROM A WIRE PROCESSING MACHINE TO A DISCHARGING POINT

CROSS-REFERENCE TO RELATED APPLICATIONS

This application is a U.S. National Phase Application under 35 U.S.C. 371 of International Application No. PCT/DE2021/100828, filed on Oct. 14, 2021, which claims the benefit of German Patent Application No. 20 2020 107 214.5, filed on Dec. 14, 2020. The entire disclosures of the above applications are incorporated herein by reference.

BACKGROUND

This section provides background information related to the present disclosure which is not necessarily prior art.

TECHNICAL FIELD

The invention relates to an arrangement for transporting a wire processing machine to a discharging point for manual, partially automated or fully automated wiring in switchgear and controlgear construction. Such an arrangement can be used in particular if, in order to achieve the highest possible vertical range of manufacture from wire fabrication to wiring of the switchgear and/or control system, all process steps are to be carried out on site and preferably substantially simultaneously.

DISCUSSION

In the construction of switchgear and control systems, the wiring process is one of the central and most time-consuming operations, which is still often carried out completely manually. Not only the high complexity of the work process but also the demand for complete freedom from errors places great demands on the people working in switchgear and control system construction.

Various technical aids with different levels of support are known for optimizing the wiring process. These range from hand tools and/or semi-automatic machines for wire assembly to fully automatic systems which completely preassemble individual wires, for example by cutting to length, stripping, applying a wire end ferrule and crimping, and then make them available as a loose, individual wire, a wire chain of sequentially interconnected preassembled individual wires, or in the form of a wire magazine on which the individual wires are sequentially lined up.

However, as an interface for picking up and handling preassembled wires with a robot for the automated wiring process, no technical solution is known to date. In particular, it has proved to be particularly complex to separate prefabricated wires provided as wire bundles or wire sequences for handling by the robot, which is related in particular to the fact that wires are flexible components.

SUMMARY

This section provides a general summary of the disclosure, and is not a comprehensive disclosure of its full scope or all of its features.

It is therefore one aspect of the invention to propose an arrangement of the type described above, which permits the reception and handling of prefabricated wires by a discharging point for the partially or fully automated wiring of a switchgear or control system.

Accordingly, it is provided that the arrangement comprises an automatic wire processing machine and an air pressure transport system, wherein a wire transfer interface between the automatic wire processing machine and the air pressure transport system comprises a wire reception arranged in the access area of the automatic wire processing machine and further comprises a wire outlet which opens into at least one transport line of the air pressure transport system, wherein the at least one transport line is guided between the wire transfer interface and a discharging point.

The arrangement according to the invention allows that instead of a prefabricated wire bundle consisting of a multitude of prefabricated individual wires, which have to be separated again for the automated wiring, a respective prefabricated wire to be wired can be produced directly before the wiring by means of the automatic wire processing machine and fed as individual wire via the air pressure transport system to the discharging point, for example to an articulated arm robot, prefabricated wire to be wired can be produced directly before wiring with the aid of the automatic wire preparation machine and fed as a single wire via the air pressure transport system to the discharging point, for example to an articulated arm robot, so that the separation of a wire bundle or a wire sequence and, if necessary, the identification of the individual wires of the bundle or the sequence are omitted.

Because the prefabricated wire passes through the transport line, the prefabricated wire, which is usually a flexible component, is fed to the pickup station in a directed manner. This ensures that the wire with its wire end treatment, for example a wire end sleeve, reaches the pickup station first, for example the end effector of an articulated arm robot, so that the robot can reliably grip the wire at the wire end treatment, for example the wire end sleeve.

If the discharging point has an articulated arm robot, it can be provided that the transport line opens directly into an end effector of the articulated arm robot. The articulated-arm robot can have a prior art wire passage brake consisting of two counter-rotating rollers, belts or straps forming a nip, with the aid of which the individual wire fed to the end effector can be fed at a defined feed rate, for example to a gripper of the end effector, at a feed rate resulting from the rotational speed of the rollers, belts or straps. Instead of a separate wire passage brake, a pair of rollers, belts or straps provided for the wire transport at the end effector can be used to brake the wire rushing along the transport line to a defined feed speed. A suitable end effector is known from DE 10 2019 106 710 A1.

The pickup station can be a workstation for semi-automated wiring as described in WO 2019/211 460 A1. A pickup station for fully automated wiring with an articulated arm robot is described in DE 10 2018 133 319 A1.

The wire transfer interface may comprise an overpressure chamber which may be pressurized by a pressure source with a fluid pressure, for example with an air pressure, in order to transport a prefabricated wire introduced into the wire transfer interface via the wire receiving section in the direction of the wire output and through the transport line to the discharging point. The discharging point may have a wire output, for example a wire brake of the type described above with two counter-rotating rollers, belts, or belts forming a nip, the nip being just adapted to the wire diameter. Such wire passage brakes are known from the prior art. A similar wire passage brake is also described in EP 0654436 A1.

In one embodiment, it may be provided that the discharging point comprises a robot, such as an articulated robot, having a multifunctional end effector, the end effector comprising a feed hose for a wire, for example a hose made of polytetrafluoroethylene. The feed tube may be the transport line, which extends to the wire transfer interface. In this way, an almost closed system can be created which allows compressed air to be applied and enables a prefabricated wire fed into the system via the wire transfer interface to be conveyed at high speed through the transport line to the end effector of the robot, for example to the grippers of the end effector. Conveyor rollers, rolls, or belts may be provided immediately upstream of the gripper to feed the wire to the gripper. These conveyor rollers can be used to slow down the prefabricated wire supplied at high speed via the transport line to a speed suitable for acceptance by a gripper of the end effector, for example according to the principle of a wire passage brake described above. For example, a prefabricated wire can have a cross-section between 0.5 and 6 $mm^2$. The wire can be provided with or without wire end treatment (partial pull-off, wire end sleeve, etc.).

Due to the comparatively high cycle rates of prior art wire processing machines, the arrangement can have several discharging points which are supplied with pre-harnessed wires from the same wire processing machine. In order to be able to supply the prefabricated wires individually to the discharging points, a wire switch can be used. The wire switch can be part of the wire transfer interface or can be integrated in the at least one transport line downstream in the wire feed direction of the wire transfer interface. In one embodiment, in the best case only a single transport line can be provided in the wire feed direction up to the switch, or two transport lines can be provided for different wire cross-section ranges, while in the feed direction of the switch any number of transport lines downstream of the number of discharging points to be supplied are provided, each transport line being fed to one of the plurality of discharging points, for example to a robot and/or a manual workstation. Considering the cycle rates that can be realized with the automatic wire processing machine compared to the cycle rates for automated, semi-automated, or manual wiring, an automatic wire processing machine can be used to serve about ten or more pickup stations, so that the switch can have a corresponding number of pickup transport lines at its output side.

The wire transfer interface may have an overpressure chamber that opens into the transport line and into the wire receiving unit. A fluidic transition between the overpressure chamber and the wire receiving unit can be closed and opened by an adjustable closing member of the wire transfer interface. When the closing member is open, a prefabricated wire provided by the automatic wire fabrication machine can be introduced through the wire receiving unit up to the overpressure chamber, for which purpose, for example, a suitable transport means for the wire can be provided upstream of the overpressure chamber or in the overpressure chamber, for example a pair of counter-rotating conveyor rollers.

After the prefabricated wire has passed through the wire intake over its entire length, i.e. has reached the overpressure chamber with its rear end in the feed direction, the adjustable closing member can fluidically seal the overpressure chamber with respect to the wire intake. The overpressure chamber can be permanently open to the wire outlet. The overpressure chamber may be connected to a source of overpressure, such as a compressor. Via a valve, a fluid, for example air, can be metered from the overpressure source into the overpressure chamber at a specific pressure and/or volume flow, so that the fluid leaves the overpressure chamber via the transport line, entraining or pushing the prefabricated wire arranged in the overpressure chamber and thus transporting it through the transport line in the direction of the discharging point.

The adjustable closing member may comprise a slide, preferably a flat slide, which can be adjusted by a linear actuator, for example a pneumatic piston, between an open position in which the fluidic transition is released and a closed position in which the fluidic transition is closed.

The slide may have a through bore and, spaced therefrom, an annular sealing element, wherein, in the open position of the adjustable closing member, the through bore connects a wire entry channel of the wire receiver to the overpressure chamber, and wherein, in the closed position, the annular sealing element sealingly surrounds the wire entry channel.

The closing member may have an control flap that can be adjusted between an open position, with which it clears a wire entry opening of the wire receiving unit, and a closed position, in which the control flap rests against an outside of the wire transfer interface and closes the wire entry opening.

The control flap can be adjustable about a pivot axis between the open position and the closed position and can be driven by a linear drive, for example by a pneumatic piston. The pneumatic lever can drive a toggle mechanism with which the control flap is completely removed from the alignment of the wire entry opening in the open position, so that the wire entry opening is freely accessible for feeding a wire, for example with the aid of a transfer tube. The transfer tube can be positioned in front of the wire entry opening in the alignment of the wire entry opening by a few millimeters, somewhat less than 10 mm, in order to feed a prefabricated wire produced by the automatic wire processing machine in a directed manner to the wire entry opening. The transfer tube can in particular be a straight tube section or have such a section, so that the prefabricated wire, which can be a flexible component, leaves the transfer tube as a substantially straight wire and also retains this geometry, since the wire, after leaving the transfer tube, only has to pass a few millimeters, preferably less than 10 mm, until it enters the wire entry opening and undergoes further guidance there due to the geometry of the wire entry opening or of a wire entry channel adjoining the wire entry opening and thus remains as an essentially straight conductor.

The adjustable closing member may have a closing piston rotatable about its longitudinal axis with a through bore extending perpendicularly to the longitudinal axis, which in an open position of the adjustable closing member connects a wire inlet channel of the wire intake with the overpressure chamber and thus establishes the fluidic transition, and in a closing position rotated relative thereto closes the wire inlet channel.

The wire receiving unit can have a wire transport means upstream of its wire entry opening, with which a wire prefabricated by the automatic wire preparation machine is fed into a wire entry opening of the wire receiving unit. The wire transport means may include, for example, a pair of counter-rotating rollers or belts. A nip may be formed between the rollers or rimes through which the wire is transported and either fed into the wire entry opening of the wire transfer interface when the pair of counter-rotating rollers or belts is located outside the overpressure chamber, or withdrawn from the wire entry opening and fed into a channel 22 opening into the wire outlet when the pair of counter-rotating rollers or belts is located inside the overpressure chamber.

The nip, such as a roll nip, may have an adjustable width, wherein in a transport position of the rolls or belts the width of the nip substantially corresponds to the diameter of a wire to be transported. In an out-of-service position of the rolls or belts, the width of the nip may be greater than or equal to a dimension of the wire entry opening so as to permit unobstructed wire entry at least into the access area of the rolls or belts and, if necessary, the displacement, in particular the pivoting, of an adjustable closing member, for example an control flap, between an open position and a closed position, the control flap being pivoted out of the alignment of the wire entry opening in the open position, so that the control flap is moved through between the rollers or belts of the wire transport means located in the inoperative position when it is pivoted out of the closed position into the open position.

A wire entry opening on an outer side of the wire transfer interface may be preceded by a piston which is linearly adjustable along its longitudinal axis, is fully retracted from the wire entry opening in its retracted position, and enters the wire transfer interface through the wire entry opening in its extended position.

In its extended position, the piston, which is linearly adjustable along its longitudinal axis, can penetrate the wire transfer interface through the wire entry opening at least to such an extent that its free end passes the adjustable closing member, preferably a through bore of a linearly adjustable slide or of a closing piston which can be rotated about its longitudinal axis, when the adjustable closing member releases the fluidic transition. In particular, the linearly adjustable plunger can be used to push a prefabricated wire introduced into the wire transfer interface via the wire entry port into the overpressure chamber until behind the effective range of the adjustable closing member, so that the overpressure chamber can be fluidically isolated for transport of the wire from the overpressure chamber into the transport line opposite the wire receiving unit.

In addition to its adjustability along its axial direction, the linearly adjustable piston can have a further adjustability in which the linearly adjustable piston is arranged in a swung-in position with its longitudinal axis perpendicular to the wire entry opening and in alignment with the wire entry opening. In a swung-out position, the linearly adjustable piston can be arranged completely outside the alignment of the wire entry opening, so that the feeding of a prefabricated wire, for example with the aid of the transfer tube described above, can take place unhindered.

The automatic wire processing machine may include a conveyor head from which a pre-harnessed wire produced by the automatic wire processing machine is fed into a straight transfer tube. The transfer tube may be aligned with the wire entry opening, and through the transfer tube the wire may be fed to the wire transport means as an aligned wire.

The wire transfer interface may include a presence sensor 26 configured to detect the presence of a wire in the wire transfer interface or the exit of a wire from the wire transfer interface.

In order to be able to serve several discharging points with an automatic wire processing machine, it can be provided that the air pressure transport system has a wire diverter. The wire switch can have a wire input 28 and several wire outputs 29. A pre-terminated wire may be fed to the wire input from the wire transfer interface. The wire outputs may each be connected to one of the pickup stations via a transport line. The wire switch can have an actuator 30 with which the prefabricated wire fed via the wire input is fed into that one of the transport lines which is connected to a target discharging point of the discharging points for the prefabricated wire. The wire switch can be used to increase the utilization rate of the automatic wire processing machine, which is a substantial investment object, by having the automatic wire processing machine serve multiple discharging points using the wire switch. Investigations have shown that the cycle rate of the automatic wire processing machine is about ten times higher than the cycle rate for manual, semi-automated or automated wiring, so that accordingly about ten discharging systems can be served by a common automatic wire processing machine using the described wire diverter with pre-assembled wires.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
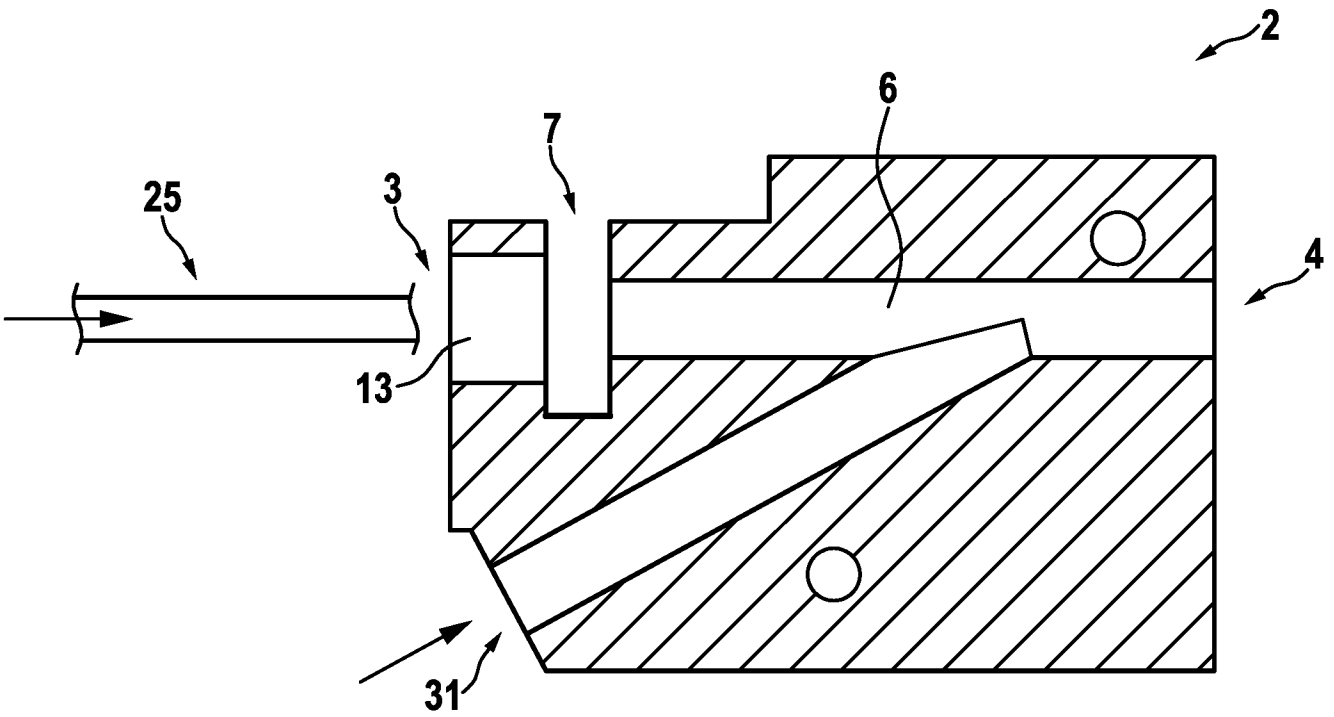
Figure 4:
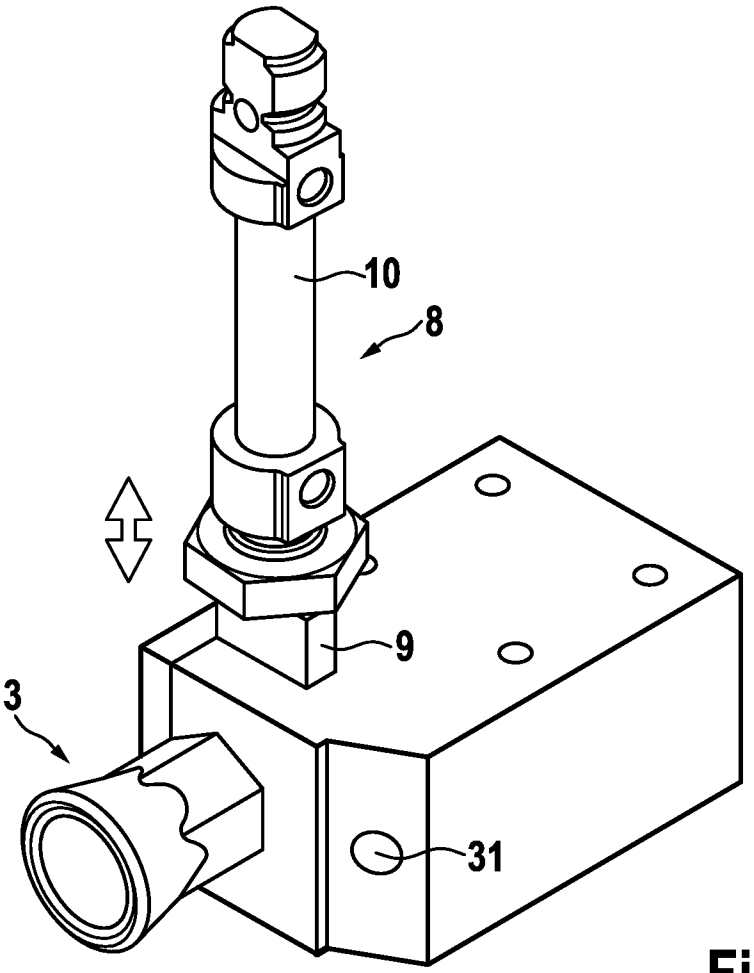
Figure 3:
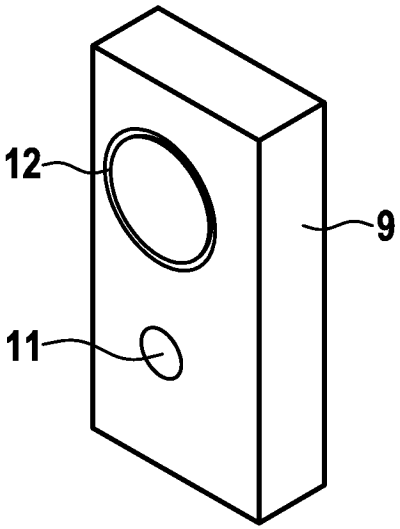
Figure 5:
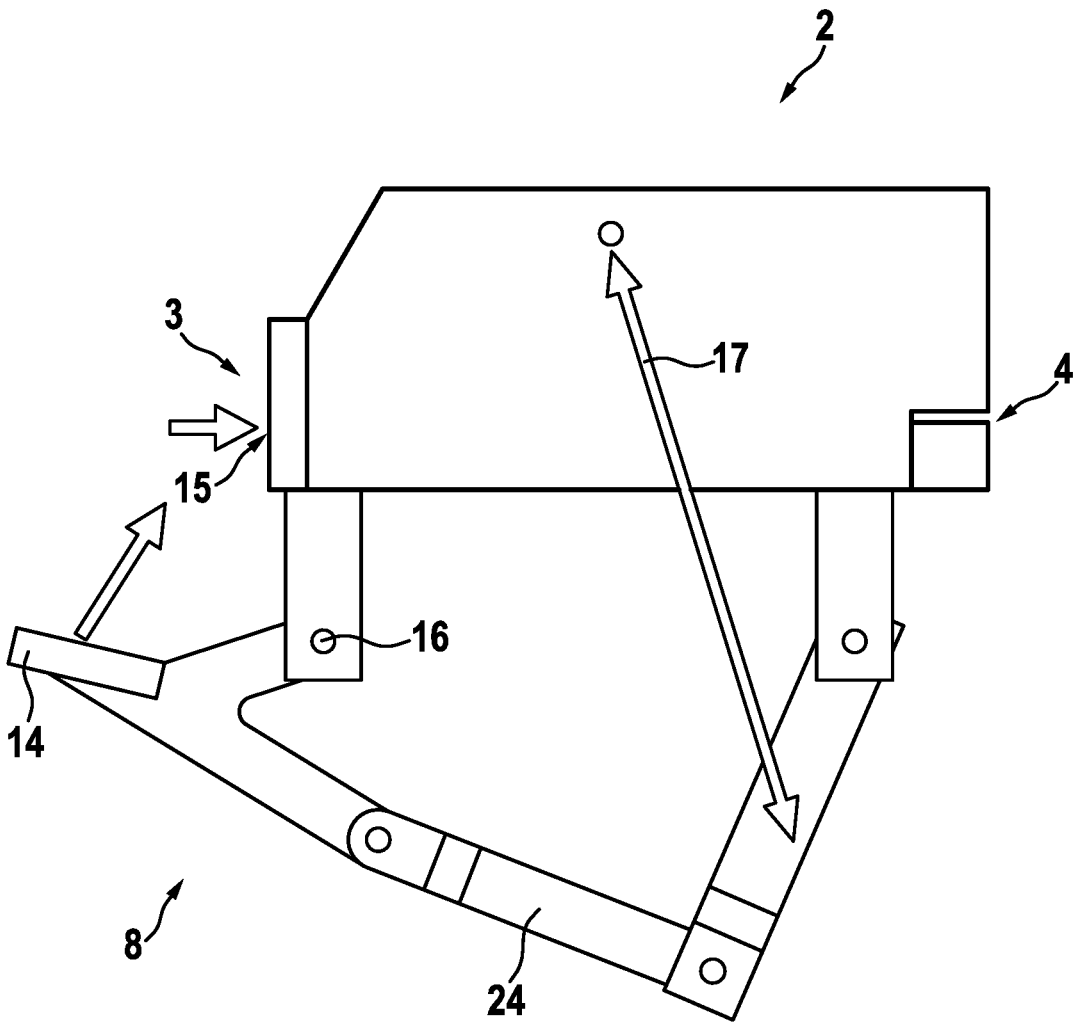
Figure 7:
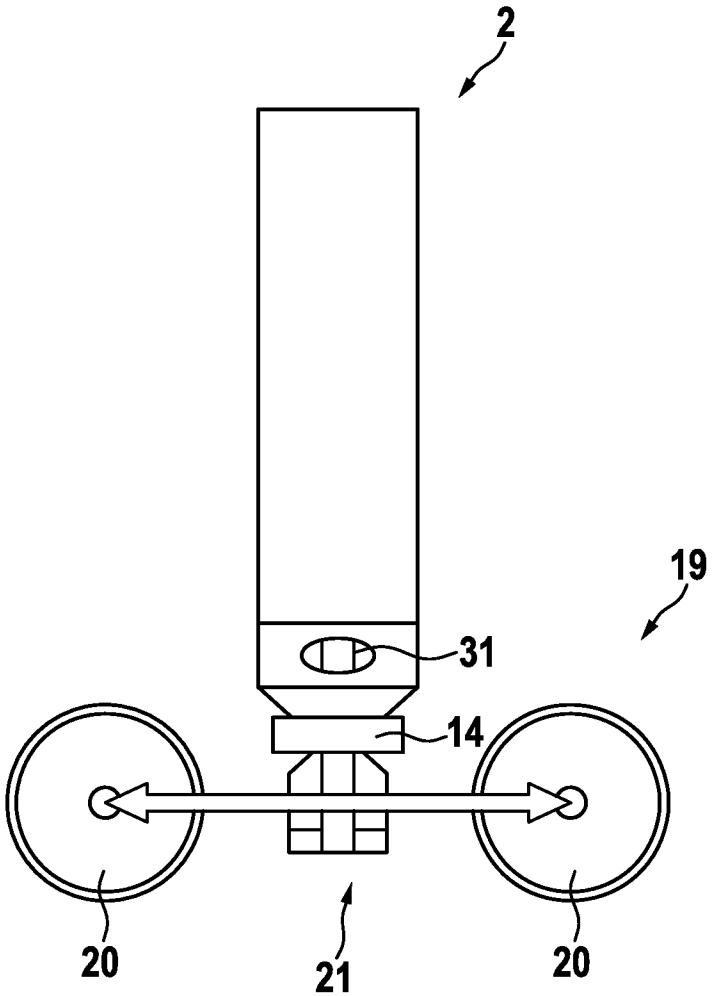
Figure 6:
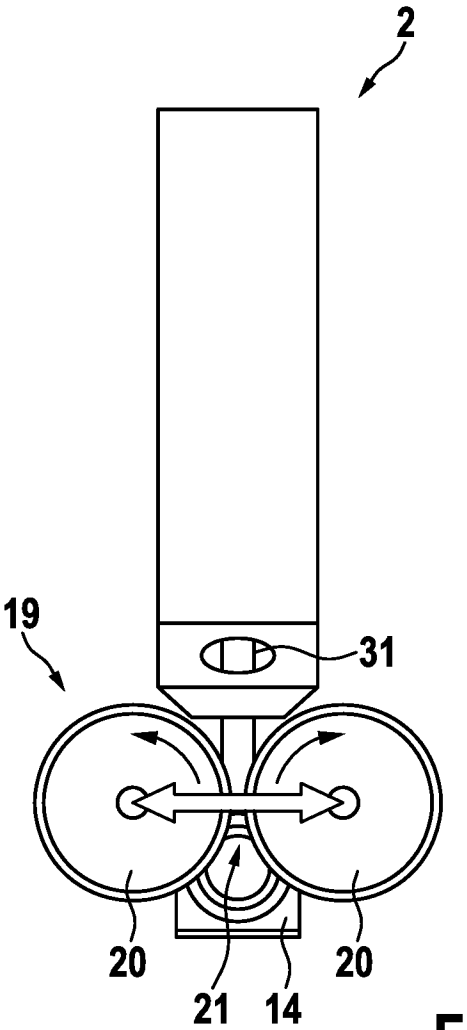
Figure 8:
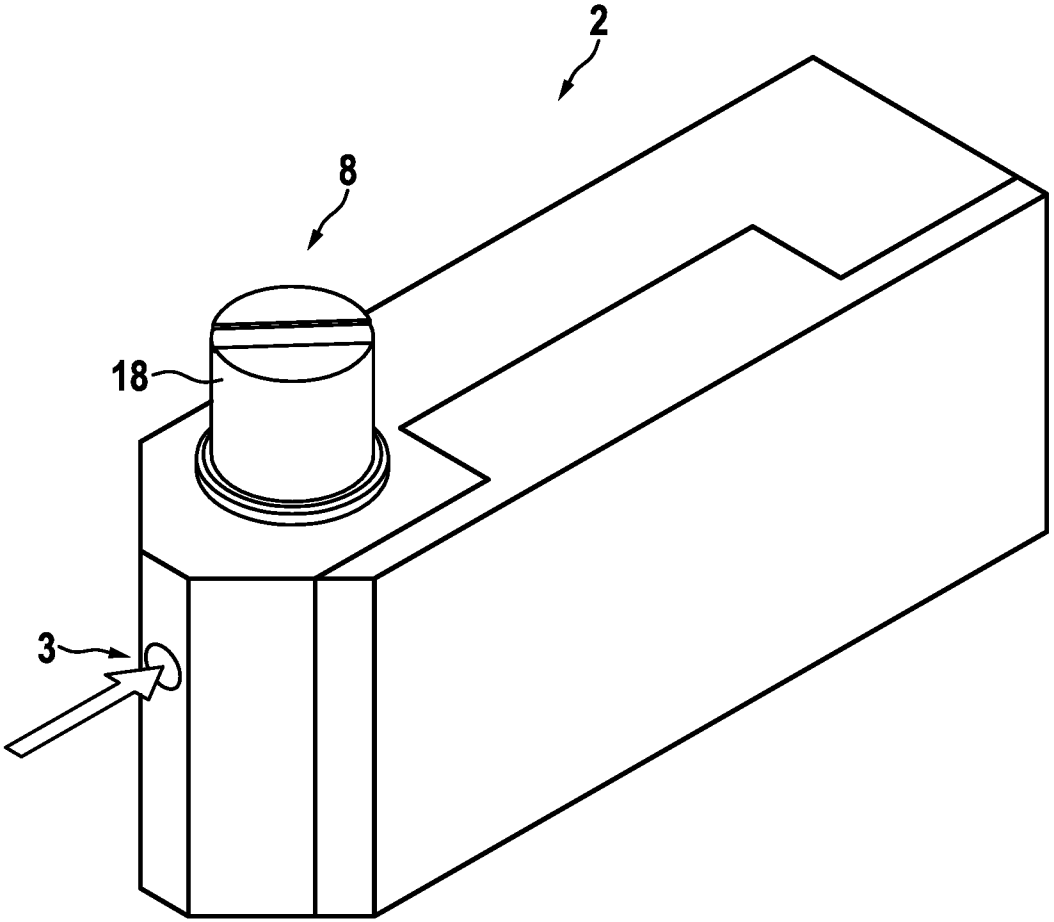
Figure 9:
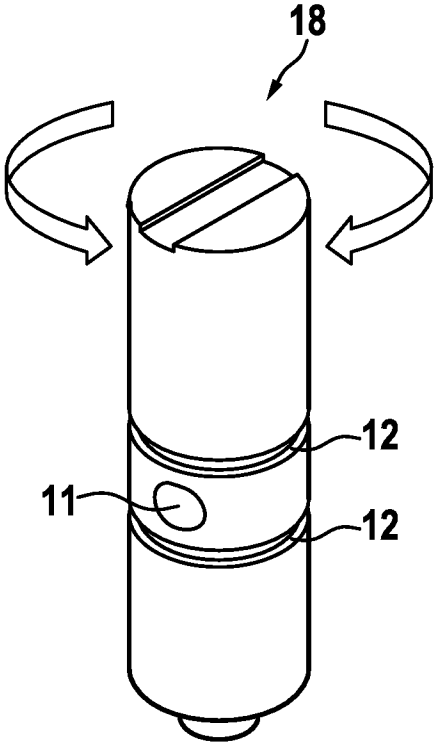
Figure 10:
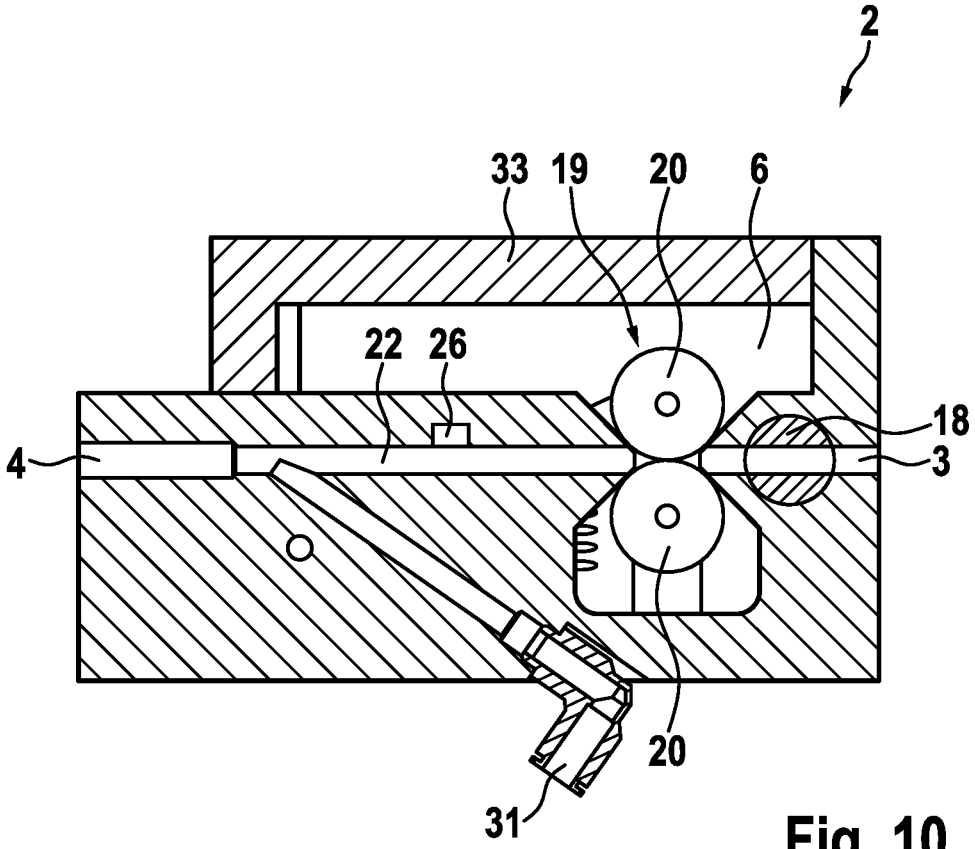
Figure 11:
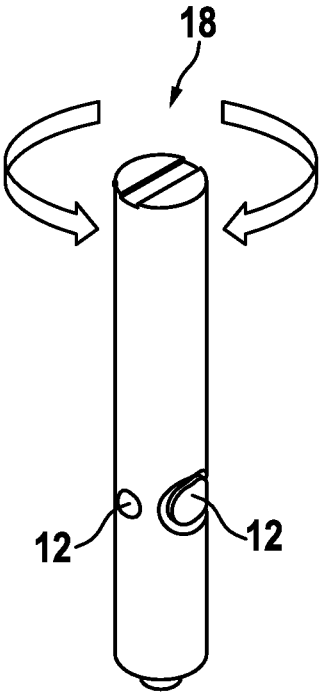
Figure 12:
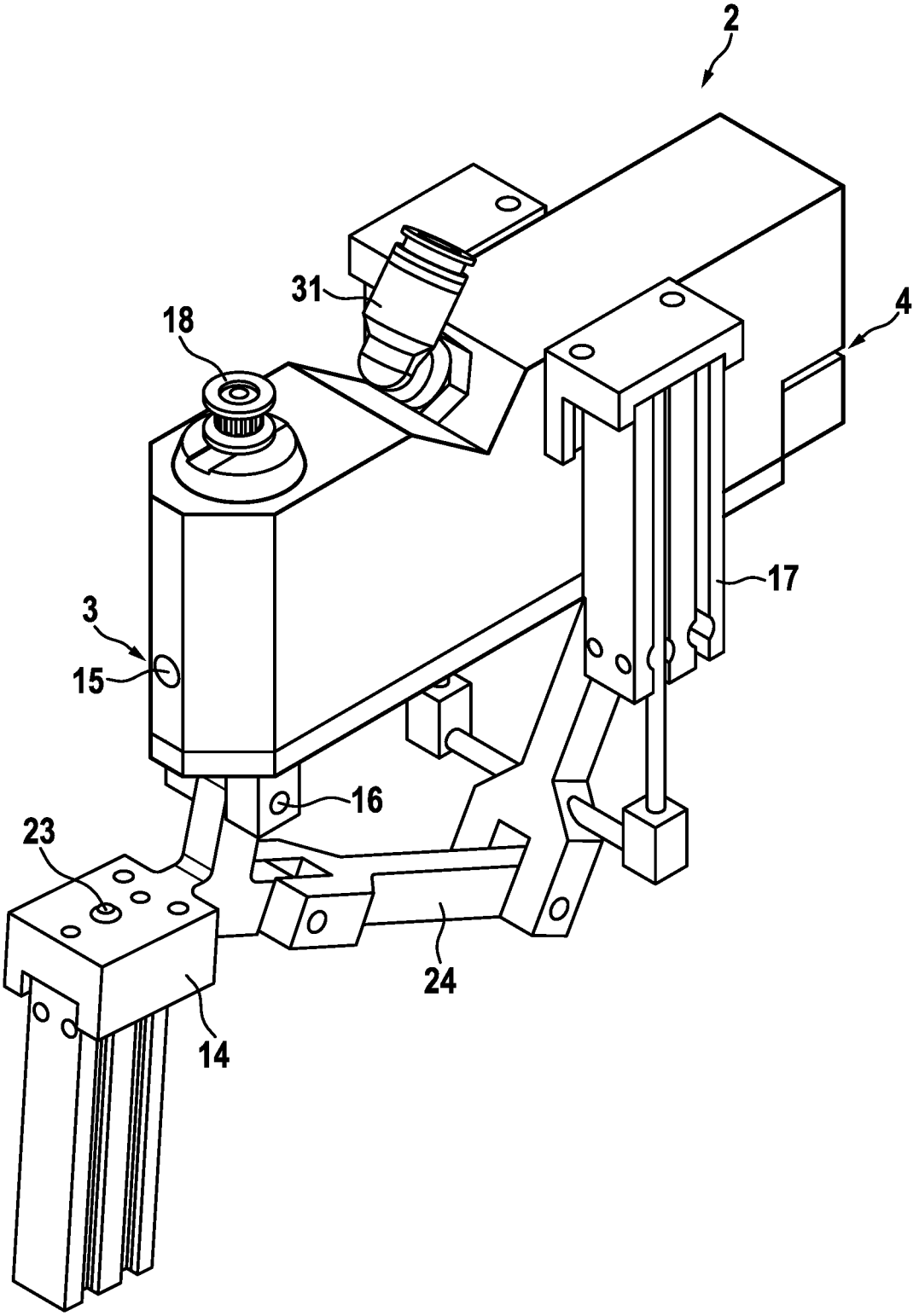
Figure 13:
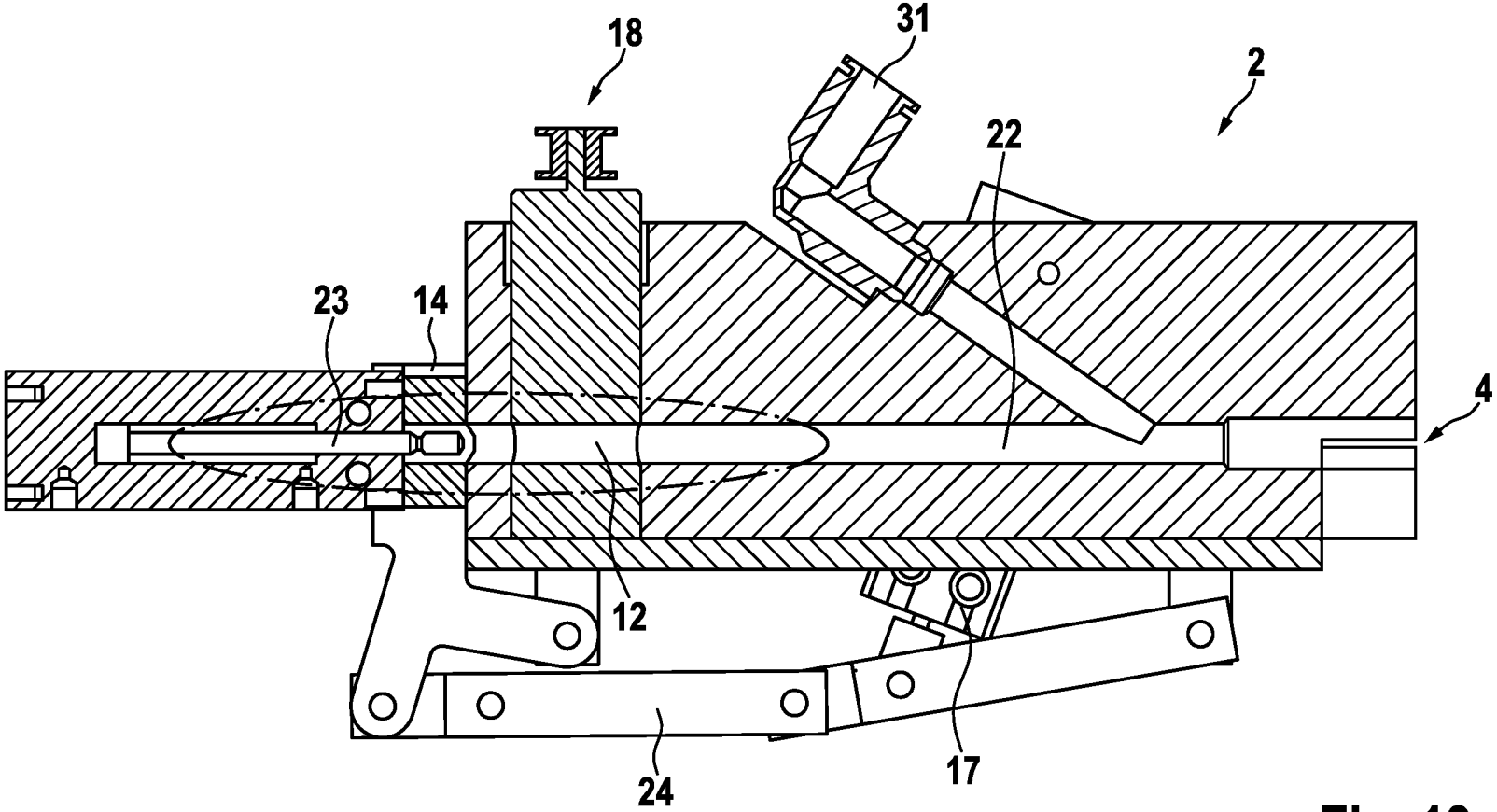
Figure 14:
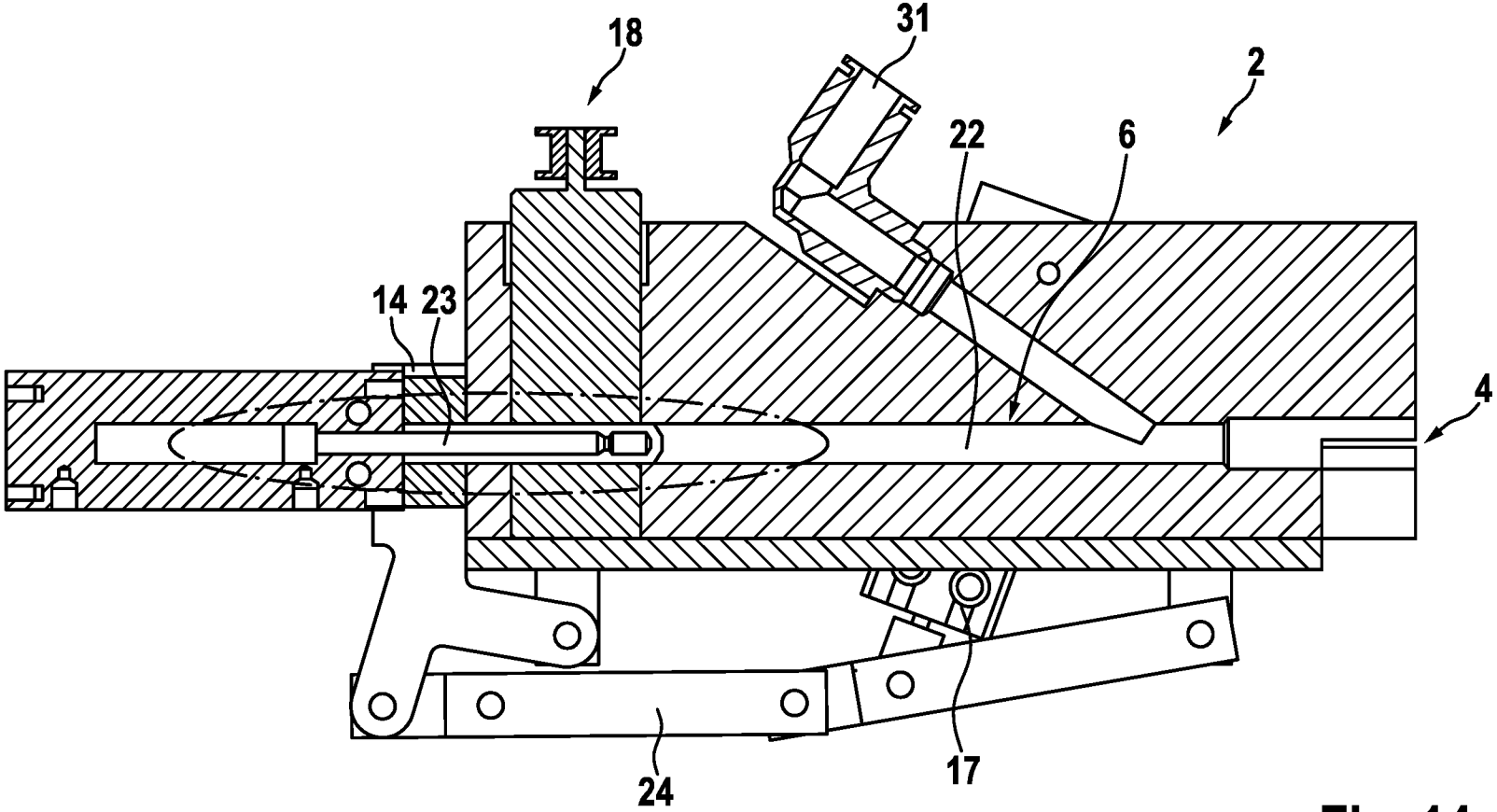
Figure 15:
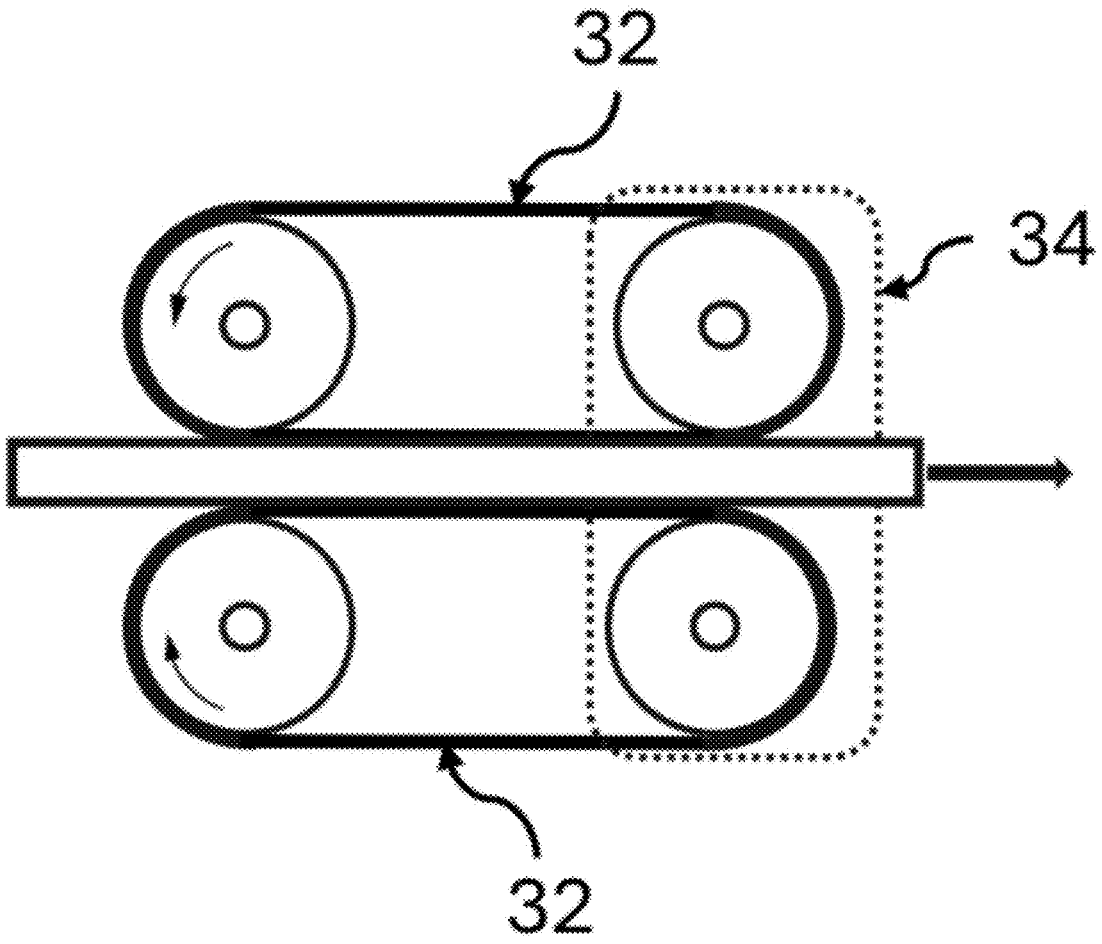

Further details of the invention are explained with reference to the figures below. Thereby shows:

FIG. 1 shows a schematic representation of an exemplary embodiment of an arrangement according to the invention;

FIG. 2 a cross-sectional view of an exemplary embodiment of a wire transfer interface;

FIG. 3 a perspective view of a slide of a closing member of the wire transfer interface according to FIG. 2;

FIG. 4 a perspective view of the wire transfer interface according to FIG. 2;

FIG. 5 a side view of another exemplary embodiment of a wire transfer interface;

FIG. 6 a top view of another exemplary embodiment of a wire transfer interface with a transport means in the operating position;

FIG. 7 the embodiment and view according to FIG. 6 with the transport means in an inoperative position;

FIG. 8 a perspective view of a further embodiment of a wire transfer interface according to the invention;

FIG. 9 a perspective view of the closing piston of the embodiment according to FIG. 8;

FIG. 10 a cross-sectional view of another embodiment of a wire transfer interface;

FIG. 11 a perspective view of the closing piston of the embodiment according to FIG. 10;

FIG. 12 in perspective view of a further embodiment of a wire transfer interface;

FIG. 13 a cross-sectional view of the embodiment according to FIG. 12 with a linearly adjustable piston in its retracted position;

FIG. 14 the embodiment and view according to FIG. 12, with the linearly adjustable piston arranged in its extended position; and FIG. 15 illustrates an embodiment of a wire transport.

DETAILED DESCRIPTION

Example embodiments will now be described more fully with reference to the accompanying drawings.

FIG. 1 shows a schematic representation of an exemplary embodiment of an arrangement according to the invention for transporting a wire from an automatic wire processing machine 200 to a discharging point 300. In particular, the automatic wire processing machine 200 serves two different discharging points 300, one discharging point for the robot-assisted wiring of a control or switchgear system and one workstation for manual or partially automated wiring. The automatic wire processing machine 200 is set up and controlled to provide the two pick-up points 300 with a prefabricated wire required for a wiring step just in time according to a predefined cycle rate and parts list. After the automatic wire processing machine 200 generates a prefabricated wire 100, it can be fed from the automatic wire processing machine 200 into an air pressure transport system 1 using a wire transfer interface. After the prefabricated wire 100 has been transferred into the air pressure transport system 1 via the wire transfer interface 2, the wire passes through the wire diverter 27, which introduces the wire into a transport line 5 associated with the relevant receiving point in accordance with its intended receiving point. The transport line can be a hose which has a friction-reducing coating at least on its inner wall. Alternatively, the hose may be solidly made of a material with a low coefficient of friction. For example, the hose may have a coating of polytetrafluoroethylene or be made of this material. The hose may be made of multiple sections, and hose couplings may be used to connect sections of the hose together to form the transport line 5.

When the wire 100 reaches the intended discharging point 300 along the transport line 5, it can be braked there with the aid of a wire brake and made available for manual discharging at the discharging point 300 designed as a workstation or for feeding the wire 100 to an end effector of the robot-assisted discharging point 300. A suitable wire passage brake is described, for example, in EP 0654436 A1. In the case of the articulated arm robot, a pair of rollers or rolls that are present anyway for the wire feed in the end effector can be used as a wire passage brake, so that the rollers or rolls have a dual function. A suitable end effector is described in DE 10 2019 106 710 A1.

Since the automatic wire processing machine 200 can produce the wires 100 to be wired much faster than they can be further processed at the discharging points 300, i.e. the automatic wire processing machine 200 has a much higher cycle rate than the discharging points 300, the automatic wire processing machine 200 can serve a large number of discharging points 300, and in particular more than the two shown. Experiments have shown that at least about ten discharging points 300 can be served by automatic wire processing machines 200 common in the prior art.

In particular, the arrangement according to the invention makes it possible for the wires to be produced just in time and made available to the receiving point, so that a buffer store for pre-assembled wires is not necessarily required. However, in order to increase the utilization of the automatic wire processing machine 200, a buffer store (not shown) for harnessed wires may be provided. This may be arranged, for example, in the transport line 5 between the wire transfer interface 2 and a discharging point 300. Furthermore, it is no longer necessary to prepare wire sequences, for example in the form of wire bundles, which would require the wires to be separated and identified prior to wiring, thus greatly increasing the processing effort compared to the arrangement according to the invention.

FIGS. 2 to 4 show an exemplary embodiment of a wire transfer interface 2 according to the invention. The wire transfer interface 2 has a wire receiving unit 3 and a wire output unit 4. Pre-assembled wires are fed to the wire transfer interface 2 from an automatic wire assembly machine via the wire receiving unit 3. In order to ensure reliable and directional wire feeding, a transfer tube 25 can be provided, particularly for wires with a low conductor cross-section and thus high bending slackness, which is aligned with the wire receiving unit point so that the prefabricated wire only has to bridge a few millimeters after leaving the automatic wire processing machine until it reaches the opening 3.

After the wire enters the wire transfer interface 2 through the wire receiving unit 3, the wire passes a fluidic transition 7, in which a closing member 8 is arranged. The closing member 8 is arranged to selectively fluidically isolate or release the wire receiving unit 3 with respect to an overpressure chamber 6 of the wire transfer interface 2. For the introduction of the wire into the wire transfer interface 2 and preferably into the overpressure chamber 6, the wire can pass through a through bore 11 of a flat slide 9 in an open position of a closing member 8. After the wire has completely passed the slide 9 and in particular the through bore 11, i.e. in particular has also arrived in the overpressure chamber 6 with its wire end at the rear in the feed direction, the closing member 8 can be brought into its closed position. For this purpose, the slide 9 can be moved linearly, i.e., in the embodiment according to FIGS. 2 to 3, it can be pushed further into the housing of the wire transfer interface 2 until an annular sealing element 12, which is arranged on a closed side of the slide 9 facing the overpressure chamber 6, fluidically seals the fluidic transition 7 between the overpressure chamber 6 and the wire entry channel 13. The slide 9 can be adjusted between the open position and the closed position by means of a linear actuator 10, for example a pneumatic piston.

After the prefabricated wire has arrived in the wire transfer interface 2 and the closing member 8 has been arranged in its closed position, a fluid pressure, in particular an air pressure, can be applied to the overpressure chamber 6 via a pressure port 31. The compressed air flowing into the wire transfer interface 2 via the pressure port 31 can leave the wire transfer interface 2 only via the wire outlet 4, the compressed air entraining or pushing the wire arranged in the overpressure chamber 6 and introducing it into a transport line 5 connected to the wire outlet 4, for example a hose made of polytetrafluoroethylene.

FIG. 5 shows an alternative embodiment of a wire transfer interface 2 according to the invention, in which, in deviation from the embodiment according to FIGS. 3 to 4, the closing member 8 is designed as a control flap 14 pivoted via a linear drive 17 and a toggle lever drive 24, which can be pivoted about a pivot axis 16. In the open position shown in FIG. 5, the control flap 14 is pivoted completely out of alignment with a front wire entry opening 15 of the wire receiving unit 3, so that a wire can enter the wire transfer interface 2 unhindered via the wire entry opening 15, for which purpose, for example, as has been described with reference to FIG. 2, a transfer tube 25 can be brought to within a few millimeters of the wire entry opening 15. After the wire has arrived at least for the most part in the wire transfer interface 2 and, at most, still protrudes from the wire reception 3 via its rear end over the wire entry opening 15, the control flap 14 can be pivoted from the open position shown in FIG. 5 into a closed position in which the control flap 14 rests against an outer side of the wire transfer interface 2 and closes the wire entry opening 15. In the course of pivoting the control flap 14 into the closed position described above, the end of the wire still projecting beyond the wire entry opening 15 can then also be pushed completely into the wire transfer interface 2. On its side facing the wire entry opening 15, the control flap 14 has a sealing element, for example an annular sealing element, which surrounds the wire entry opening 15 in the closed position, so that the wire receiving unit 3 and thus the overpressure chamber fluidically connected to it is fluidically closed off inside the wire transfer interface 2 with respect to the wire receiving unit 3 and an overpressure introduced into the overpressure chamber (cf. FIGS. 3 to 4) can be compensated exclusively via the wire outlet 4 and thus leads to a fluid flow which leaves the wire transfer interface 2 via the wire outlet 4 and in the process entrains or pushes the prefabricated wire received in the wire transfer interface 2 in the manner already described and introduces it into a transport line 5 of an air pressure transport system connected to the wire outlet 4.

In an extension of the embodiment according to FIG. 5, the embodiment according to FIGS. 6 and 7 comprises a wire transport means 19 consisting of two rollers 20 driven in opposite directions and having an adjustable roller nip 21 between them. In particular, the rollers 20 can assume a transport position according to FIG. 6 and an out-of-service position according to FIG. 7. In the transport position according to FIG. 6, the roller nip 21 has just a width which can substantially correspond to the width of a wire to be transported. In the out-of-operation position shown in FIG. 7, the roller nip 21 has a width that is sufficient to allow the control flap 14 (compare FIG. 5) to be pivoted between its open position and its closed position between the rollers 20 without interference.

In the embodiment according to FIGS. 8 and 9, deviating from embodiments according to FIGS. 2 to 4, the closing member 8 is designed as a closing piston 18 rotatable in a bushing, which has a through bore 11 perpendicular to its longitudinal axis as well as a sealing element 12 above and below the through bore 11, respectively, to seal the closing piston 18 or the bore 11 against the bushing. In an open position, the through hole 11 is aligned with the wire receiving unit 3 or a wire entry channel 13 (compare FIG. 2), so that a wire can be inserted unhindered through the sealing piston 18 into the overpressure chamber of the wire transfer interface 2. After the wire has passed the closing piston completely, i.e. also with its rear end in the feed direction, in particular has entered the overpressure chamber completely through the through hole 11, the closing piston 18 can be rotated into its closed position, for example by 90°, so that the overpressure chamber is sealed with respect to the wire receiving unit 3.

In the embodiment according to FIGS. 10 and 11, the wire transport means 19 with its two counter-rotating rollers 20 is arranged inside the overpressure chamber 6 having a cover 33. A closing member, in particular a closing piston 18, is arranged in a channel section connecting the overpressure chamber 6 with the wire receiving unit 3. The closing piston 18 can be adjusted in the manner already described with reference to FIGS. 8 and 9 between an open position and a closed position in order to achieve, on the one hand, the introduction of a wire into the overpressure chamber 6 and, on the other hand, the fluidic sealing of the wire receiving unit 3 with respect to the overpressure chamber 6. Compared to the embodiments shown in the preceding figures, the embodiment according to FIGS. 11 and 12 has the advantage that, due to the arrangement of the wire transport means 19 inside the overpressure chamber 6, the wire introduced via the wire receiving unit 3 can be drawn into the overpressure chamber 6 completely and without the aid of further technical means, in particular also until a wire end that is rearward in the feed direction has completely passed the closing member, in particular the closing piston 18, so that the closing piston 18 can be adjusted unhindered between its open position and its closed position.

The embodiment shown in FIGS. 12 to 14 combines a number of the features described with reference to the preceding figures and, in addition, has on its control flap 14 a piston 23 which is linearly adjustable along its longitudinal direction and which, in its retracted position, is fully retracted from the wire entry opening 15 and which, in its extended position, penetrates through the wire entry opening 15 into the wire transfer interface 2 when the control flap 14 is in its closed position. This allows a wire previously inserted, for example, by means of a transfer tube 25 (comp. FIG. 2) can be pushed into the overpressure chamber 6 by means of the piston 23 to such an extent that an end of the wire which is rearward in the feed direction has also completely passed a closing piston 18 of a closing member, and thus the closing piston 18 can be rotated from its open position into the closed position by a 90° rotation about its longitudinal axis without hindrance and without endangering the destruction of the wire, in order to fluidically seal the overpressure chamber 6 with respect to the wire intake 3. Accordingly, in this embodiment, the control flap 14 has no sealing function, in deviation from the embodiment according to FIG. 5.

FIG. 15 shows an alternative embodiment of a wire transport that includes a pair of counter-rotating rollers or straps 32 for exerting forward motion on a body, such as a wire, towards conveyor head 34.

The features of the invention disclosed in the foregoing description, in the drawings as well as in the claims may be essential for the realization of the invention both individually and in any combination.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An arrangement for transporting a wire from an automatic wire processing machine to a discharging point, the arrangement comprising, an automatic wire processing machine and an air pressure transport system, a wire transfer interface between the automatic wire processing machine and the air pressure transport system, the wire transfer interface having a wire receiving unit arranged in an access area of the automatic wire processing machine and a wire outlet which opens into at least one transport line of the air pressure transport system, the at least one transport line being configured to guides wires between the wire transfer interface and a discharging point, wherein the wire transfer interface includes an overpressure chamber that opens into the at least one transport line and into the wire receiving unit, wherein a fluidic transition between the overpressure chamber and the wire receiving unit can be closed and opened via an adjustable closing member of the wire transfer interface.

2. The arrangement according to claim 1, wherein the adjustable closing member comprises a slide which can be adjusted via a linear actuator between an open position, in which the fluidic transition is released, and a closed position, in which the fluidic transition is closed.

3. The arrangement according to claim 2, wherein the slide comprises a through bore and, spaced therefrom, an annular sealing element, wherein in the open position of the adjustable closing member, the through bore connects a wire entry channel of the wire receiving unit to the overpressure chamber, and wherein in the closed position, the annular sealing element sealingly surrounds the wire entry channel.

4. The arrangement according to claim 2, wherein the adjustable closing member comprises an control flap which can be adjusted between an open position, in which it clears a wire entry opening of the wire receiving unit, and a closed position, in which the control flap rests against an outer side of the wire transfer interface and closes the wire entry opening.

5. The arrangement according to claim 4, wherein the control flap is adjustable about a pivot axis between the open position and the closed position and is driven by a linear drive.

6. The arrangement of claim 2 wherein the linear actuator is a pneumatic piston.

7. The arrangement according to claim 1, wherein the adjustable closing member comprises a closing piston rotatable about its longitudinal axis and having a through bore extending perpendicularly to the longitudinal axis, which in an open position of the adjustable closing member connects a wire inlet channel of the wire receiving unit to the overpressure chamber and thus establishes the fluidic transition, and in a closed position rotated with respect thereto closes the wire inlet channel.

8. The arrangement according to claim 1, in which the wire receiving unit has, upstream of its wire entry opening, a wire transport means with which a wire prefabricated by the automatic wire processing machine is fed into the wire entry opening of the wire receiving unit.

9. The arrangement according to claim 8, wherein the wire transport means comprises a pair of counter-rotating belts, straps, or rollers between which a nip is formed through which the wire is transported and either fed into the wire entry opening of the wire transfer interface, when the pair of counter-rotating belts, straps, or rollers is located outside the overpressure chamber, or is withdrawn from the wire entry opening and fed into a channel opening into the wire outlet when the pair of counter-rotating belts, straps, or rollers is located inside the overpressure chamber.

10. The arrangement of claim 9, wherein the nip has an adjustable width, wherein in a transport position of the pair of counter-rotating belts, straps, or rollers, the width of the nip is substantially equal to a diameter of the wire to be transported, and wherein in an inoperative position of the the pair of counter-rotating belts, straps, or rollers, the width of the nip is greater than or equal to a dimension of the wire entry opening.

11. The arrangement of claim 8, wherein the automatic wire processing machine comprises a conveyor head from which the wire produced by the automatic wire processing machine is fed into a straight transfer tube which is aligned with the wire entry opening and through which the wire is fed to the wire transport means as an aligned wire.

12. The arrangement according to claim 1, in which a linearly adjustable piston is arranged upstream of a wire entry opening on an outer side of the wire transfer interface, wherein the linearly adjustable piston is fully retracted from the wire entry opening in its retracted position and penetrates the wire transfer interface through the wire entry opening in its extended position.

13. The arrangement according to claim 12, wherein the linearly adjustable piston in its extended position penetrates at least far enough through the wire entry opening into the wire transfer interface that it passes with its free end into the adjustable closing member, when the adjustable closing member releases the fluidic transition.

14. The arrangement according to claim 12, wherein the linearly adjustable piston has a further adjustability in addition to its adjustability along its axial direction, wherein the linearly adjustable piston in a swung-in position is arranged with its longitudinal axis perpendicular to the wire entry opening and in alignment with the wire entry opening, and wherein the linearly adjustable piston in a swung-out position is arranged completely outside the alignment of the wire entry opening.

15. The arrangement according to claim 12 where in the adjustable closing member is a linearly adjustable slide or a closing piston rotatable about its longitudinal axis and having a through hole.

16. The arrangement according to claim 1, wherein the wire transfer interface comprises a presence sensor adapted to detect the presence of a wire in the wire transfer interface.

17. The arrangement according to claim 1, further comprising multiple discharging points, in which the air pressure transport system has a wire switch, the wire switch having a wire inlet and a plurality of wire outlets, a prefabricated wire being fed to the wire inlet from the wire transfer interface and each of the wire outlets being connected via one of the transport lines to a discharging points, and wherein the wire switch has an actuator with which the prefabricated wire supplied via the wire inlet is fed into that one of the transport lines which is connected to a destination discharging point-of the discharging points for the prefabricated wire.

* * * * *